US009309667B2

(12) United States Patent
Thompson et al.

(10) Patent No.: US 9,309,667 B2
(45) Date of Patent: Apr. 12, 2016

(54) CONCRETE EXTERIOR WALL SYSTEM

(75) Inventors: Dean S. Thompson, Lancaster, TN (US); Robert D. Moss, Lancaster, TN (US)

(73) Assignee: Moss Thompson, LLC, Lancaster, TN (US)

( * ) Notice: Subject to any disclaimer, the term of this patent is extended or adjusted under 35 U.S.C. 154(b) by 0 days.

(21) Appl. No.: 13/445,871

(22) Filed: Apr. 12, 2012

(65) Prior Publication Data

US 2012/0260603 A1 Oct. 18, 2012

Related U.S. Application Data

(60) Provisional application No. 61/474,383, filed on Apr. 12, 2011.

(51) Int. Cl.

| | |
|---|---|
| ***E04B 2/08*** | (2006.01) |
| ***E04B 2/00*** | (2006.01) |
| ***E04C 1/39*** | (2006.01) |
| *E04B 2/02* | (2006.01) |

(52) U.S. Cl.

CPC . *E04B 2/08* (2013.01); *E04C 1/397* (2013.01); *E04B 2002/0208* (2013.01); *E04B 2002/0247* (2013.01)

(58) Field of Classification Search

CPC ..... E04B 2/08; E04B 2002/0208; E04B 2002/0247; E04C 1/397

USPC ..... 52/220.1–220.3, 404.1, 404.4, 52/405.1–405.3, 561, 569, 570, 590.1, 52/592.1, 592.6, 745.05, 745.13

See application file for complete search history.

(56) References Cited

U.S. PATENT DOCUMENTS

| | | | | | |
|---|---|---|---|---|---|
| 1,448,843 | A | * | 3/1923 | Hull | 52/436 |
| 2,049,907 | A | * | 8/1936 | Hess | 52/375 |
| 2,064,789 | A | * | 12/1936 | Faber | 52/289 |
| 2,881,614 | A | * | 4/1959 | Preininger | 52/284 |
| 3,076,293 | A | * | 2/1963 | Baudoux | 52/220.2 |
| 3,292,331 | A | * | 12/1966 | Sams | 52/405.2 |
| 3,562,988 | A | * | 2/1971 | Gregoire | 52/279 |
| 3,791,090 | A | * | 2/1974 | Kniefel | 52/590.2 |
| 3,849,960 | A | * | 11/1974 | Henry et al. | 52/569 |
| 3,956,862 | A | * | 5/1976 | Alexandre, Jr. | 52/286 |
| 4,003,172 | A | * | 1/1977 | Pawl | 52/279 |
| 4,035,975 | A | * | 7/1977 | Gergely | 52/284 |

(Continued)

FOREIGN PATENT DOCUMENTS

DE 102012205034 * 10/2013 ..... E04B 2/54

*Primary Examiner* — Rodney Mintz

(74) *Attorney, Agent, or Firm* — Lucian Wayne Beavers; Patterson Intellectual Poperty Law, PC

(57) ABSTRACT

A concrete exterior wall system for residential and commercial construction incorporates interior wood, metal or composite framing members. The wall system solves the problem of erecting heavy, hard to manage solid wall segments as well as time-consuming, complicated multi-piece wall segments. Further, the wall system eliminates the need to frame interior walls for utility access, insulation and interior finishes. Moreover, the wall system eliminates exterior maintenance and structural damage from weather, insects and the like. The wall system incorporates wood, metal or composite material interior framing with a concrete exterior that has a permanent exterior finish. Interior studs allow easy utility installation and finish applications. The shape of the wall units are designed for less weight per linear foot than conventional systems.

17 Claims, 4 Drawing Sheets

(56) References Cited

U.S. PATENT DOCUMENTS 4,478,021 A * 10/1984 Person ..... 52/375
4,751,803 A * 6/1988 Zimmerman ..... B28B 19/003 52/309.12
4,867,598 A * 9/1989 Winter, IV ..... 403/381
4,888,931 A * 12/1989 Meilleur ..... 52/426
4,896,999 A * 1/1990 Ruckstuhl ..... 405/286
4,956,958 A * 9/1990 Caroti ..... 52/605
5,067,296 A * 11/1991 Brown et al. ..... 52/404.4
5,379,565 A * 1/1995 Vienne ..... 52/606
5,485,703 A * 1/1996 Nordahl ..... 52/562
5,625,989 A * 5/1997 Brubaker et al. ..... 52/426
5,656,194 A * 8/1997 Zimmerman ..... B28B 7/0017 249/160
D387,431 S * 12/1997 Tremblay ..... D25/113
5,775,046 A * 7/1998 Fanger et al. ..... 52/590.1
5,881,511 A * 3/1999 Keller, Jr. ..... 52/220.2
5,901,520 A * 5/1999 Abdul-Baki ..... 52/592.6
6,082,067 A * 7/2000 Bott ..... 52/592.3
6,178,715 B1 * 1/2001 Pacitto et al. ..... 52/604
6,260,320 B1 * 7/2001 Di Lorenzo ..... E04B 1/04 52/250
6,305,135 B1 * 10/2001 Inaba ..... 52/590.1
6,357,194 B1 * 3/2002 Jones, Jr. ..... 52/590.1
6,796,094 B1 * 9/2004 Kelemen ..... 52/309.8
6,892,498 B1 * 5/2005 Roman ..... 52/592.1
6,931,803 B1 * 8/2005 Davis et al. ..... 52/251
7,305,803 B2 * 12/2007 Correa et al. ..... 52/604
8,490,354 B2 * 7/2013 Robinson ..... E04B 2/04 52/293.2
8,549,811 B2 * 10/2013 Dyson ..... 52/604
8,695,304 B2 * 4/2014 Robinson ..... E04B 2/04 52/284
8,887,466 B2 * 11/2014 Alvarez Moysen ..... 52/505
2002/0038532 A1 * 4/2002 Huberty ..... 52/596
2003/0014937 A1 * 1/2003 Azar ..... 52/604
2003/0074851 A1 * 4/2003 Charmat et al. ..... 52/393
2003/0079432 A1 * 5/2003 Azar ..... 52/604
2004/0065506 A1 * 4/2004 Salls ..... 181/285
2006/0000179 A1 * 1/2006 Albert ..... 52/606
2007/0199273 A1 * 8/2007 Wang ..... 52/604
2010/0095629 A1 * 4/2010 Taylor ..... 52/570
2010/0282060 A1 * 11/2010 Duke et al. ..... 89/36.02
2011/0146186 A1 * 6/2011 Summers ..... 52/568
2013/0283718 A1 * 10/2013 Robinson ..... E04B 2/04 52/503
2014/0007529 A1 * 1/2014 Alvarez Moysen ..... 52/220.2
2014/0260029 A1 * 9/2014 Browning et al. ..... 52/309.4

* cited by examiner

CONCRETE EXTERIOR WALL SYSTEM

CROSS-REFERENCE TO RELATED APPLICATIONS

This application claims the benefit of priority of U.S. provisional patent application No. 61/474,383, filed Apr. 12, 2011, the contents of which are herein incorporated by reference.

BACKGROUND OF THE INVENTION

The present invention relates to exterior wall systems and, more particularly, to a concrete exterior wall system for residential and commercial construction incorporating interior wood, metal or composite framing.

Current concrete wall systems require large, costly foundations due to extreme weight of products. These wall systems also require long erection time due to complicated multi-piece segments. These wall systems also make insulating the structure costly and difficult.

After current products are erected, utilities, insulation and interior framing and finishes cannot be easily installed by traditional methods. This increases the cost of the structure due to increased labor and material. There are also severe limitations as to the shape and design of exterior walls with existing systems.

As can be seen, there is a need for an improved concrete exterior wall system for residential and commercial construction that may incorporate interior wood, metal or composite framing.

SUMMARY OF THE INVENTION

In one aspect of the present invention, a wall system comprises base concrete segments disposed about a base of a wall; intermediate concrete segments disposed on top of the base concrete segments, the intermediate concrete segments also disposed on top of each other to a predetermined height; top concrete segments disposed on top of a top row of the intermediate concrete segments; an exterior finish disposed on the base, intermediate and top concrete segments; concrete stud sections extending from the exterior finish toward an inside of the wall system; and framing material inserts disposed on distal ends of the stud sections.

In another aspect of the present invention, a wall system comprises base concrete segments disposed about a base of a wall; intermediate concrete segments disposed on top of the base concrete segments, the intermediate concrete segments also disposed on top of each other to a predetermined height; top concrete segments disposed on top of a top row of the intermediate concrete segments; an exterior finish disposed on the base, intermediate and top concrete segments; concrete stud sections extending from the exterior finish toward an inside of the wall system; framing material inserts disposed on distal ends of the stud sections; interlocking tabs disposed on a top side of the concrete stud sections of the base concrete segments and the intermediate concrete segments; interlocking notches disposed on a bottom side of the concrete stud sections of the intermediate concrete segments and on a bottom side of the top concrete segments, wherein the interlocking notches interlock with the interlocking tabs to form a vertically aligned assembled framing stud; utility access holes disposed in the concrete stud sections; and a male V-notch at one end of the exterior finish and a female V-notch at an opposite end of the exterior finish.

These and other features, aspects and advantages of the present invention will become better understood with reference to the following drawings, description and claims.

DETAILED DESCRIPTION OF THE INVENTION

Figure 1:
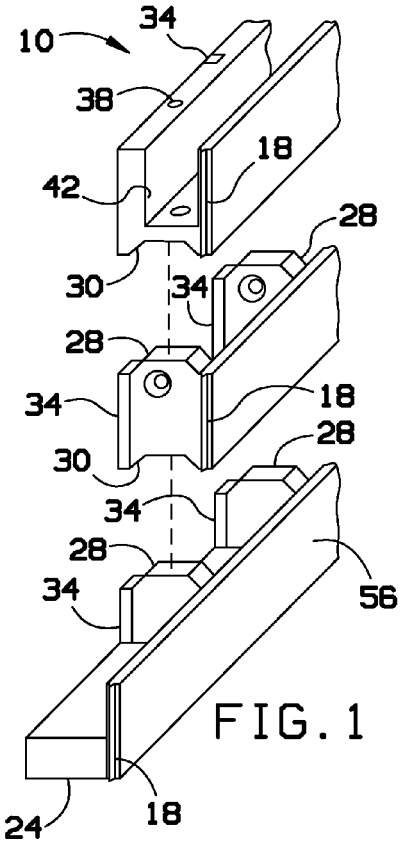
FIG. 1 is a perspective exploded view of a wall system according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a concrete exterior wall system for residential and commercial construction that incorporates interior wood, metal or composite framing members. The wall system of the present invention solves the problem of erecting heavy, hard to manage solid wall segments as well as time-consuming, complicated multi-piece wall segments. Further, the wall system of the present invention eliminates the need to frame interior walls for utility access, insulation and interior finishes. Moreover, the wall system eliminates exterior maintenance and structural damage from weather, insects and the like. The wall system incorporates wood, metal or composite material interior framing with a concrete exterior that has a permanent exterior finish. Interior studs allow easy utility installation and finish applications. The shape of the wall units are designed for less weight per linear foot than conventional systems.

Referring now to FIGS. 1 through 15, a concrete wall system 10 may include a base concrete segment 14 adapted to rest on a foundation footing 50. The base concrete segment 14 may include a decorative exterior finish 56 and a concrete base 24 disposed along a bottom edge of the base concrete segment 14. A plurality of tapered concrete stud sections 32 may extend from the decorative exterior finish 56 to the inside of the wall system 10. The stud sections 32 may have a framing material insert 34 disposed on an interior side thereof. The framing material insert 34 may be made from conventional framing material, such as wood, metal or composite, for example. The framing material inserts 34 may be connected to the stud sections 32 via a dovetail cut 36, for example.

Figure 3:
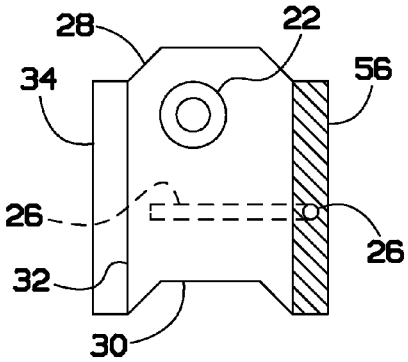
FIG. 3 is a cross-sectional view taken along line 3-3 of FIG. 2.
Figure 4:
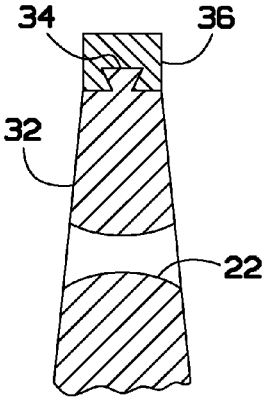
FIG. 4 is a cross-sectional view taken along line 4-4 of FIG. 2.
Figure 2:
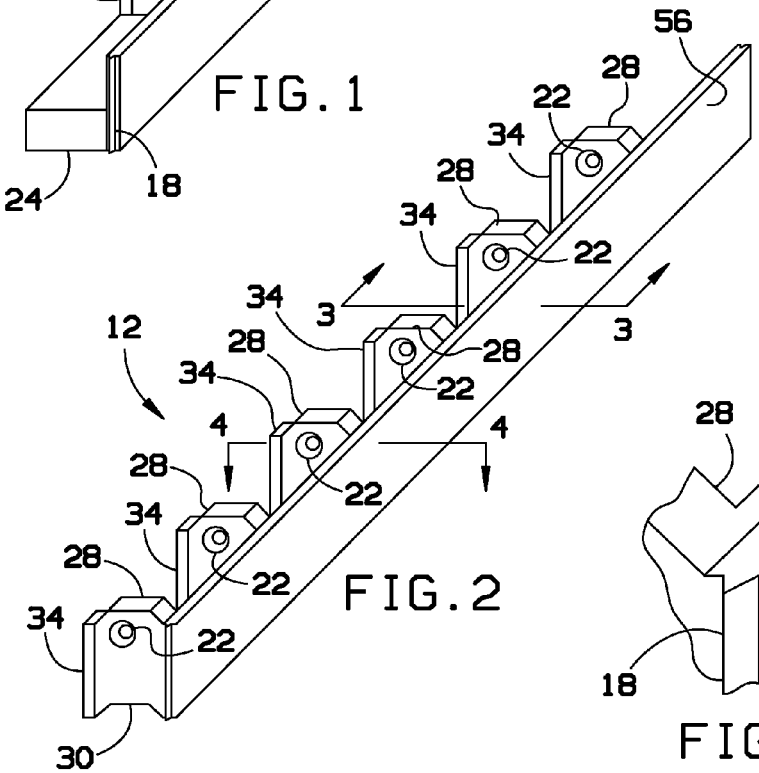
FIG. 2 is a perspective view of an intermediate concrete segment of the wall system of FIG. 1.
Figure 5:
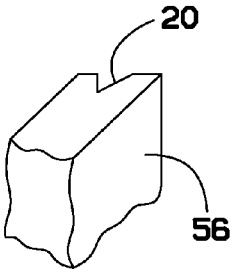
FIG. 5 is a detailed perspective view of a female end of a V-notch alignment mechanism according to an exemplary embodiment of the present invention.
Figure 6:
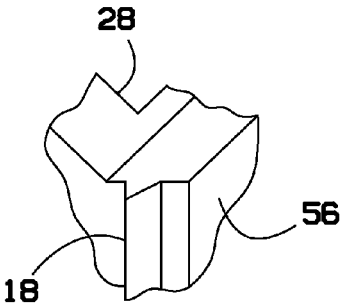
FIG. 6 is a detailed perspective view of a male end of a V-notch alignment mechanism according to an exemplary embodiment of the present invention.
Figure 8:
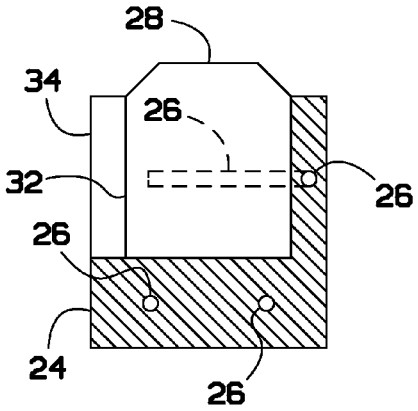
FIG. 8 is a cross-sectional view taken along line 8-8 of FIG. 7.
Figure 7:
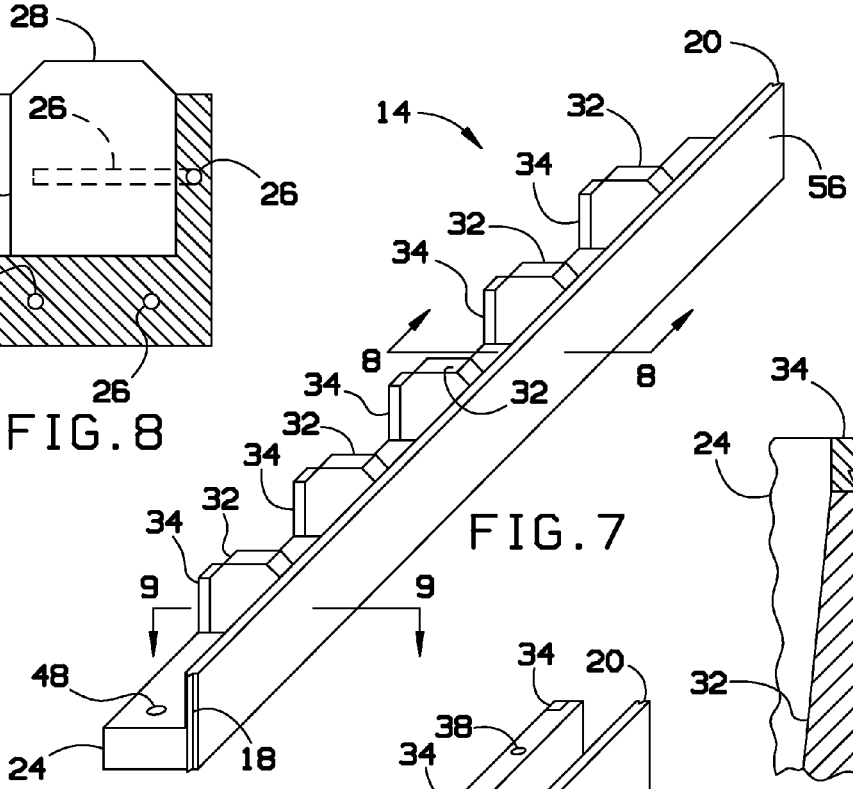
FIG. 7 is a perspective view of a base concrete segment of the wall system of FIG. 1.
Figure 9:
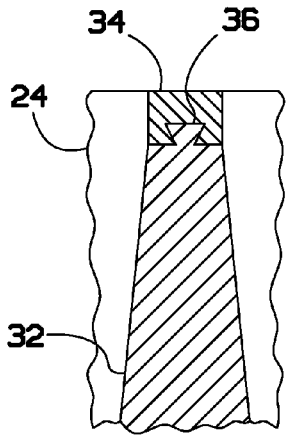
FIG. 9 is a cross-sectional view taken along line 9-9 of FIG. 7.
Figure 10:
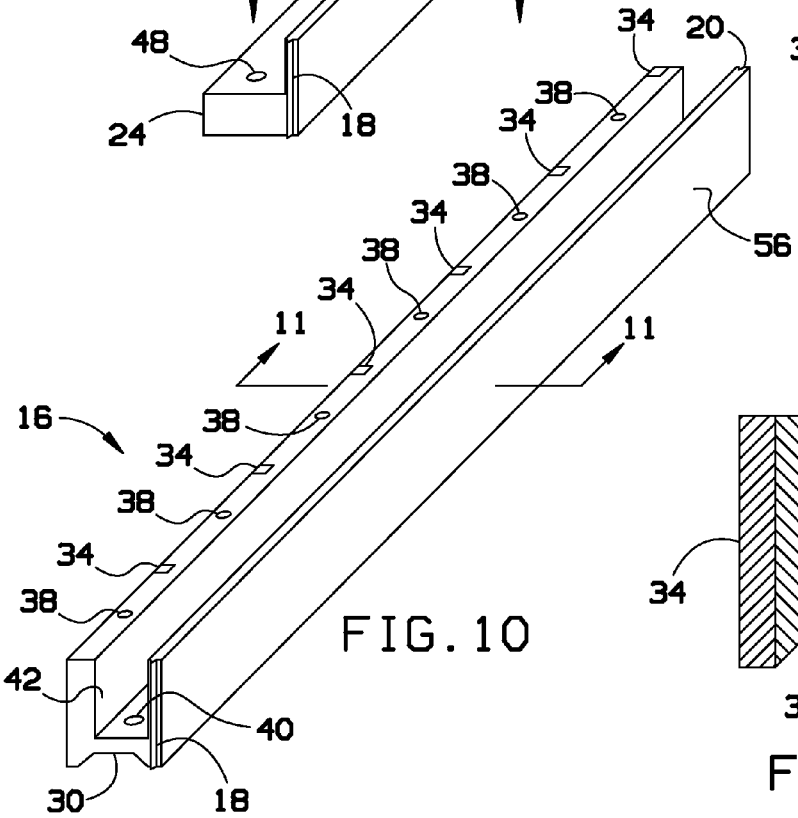
FIG. 10 is a perspective view of a top concrete segment of the wall system of FIG. 1.
Figure 11:
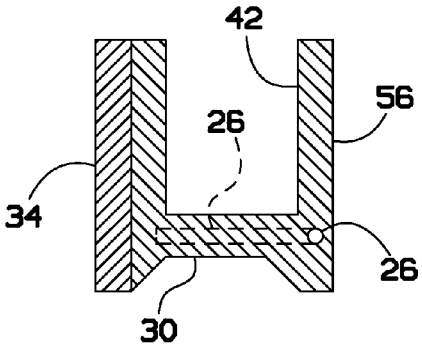
FIG. 11 is a cross-sectional view taken along line 11-11 of FIG. 10.
Figure 12:
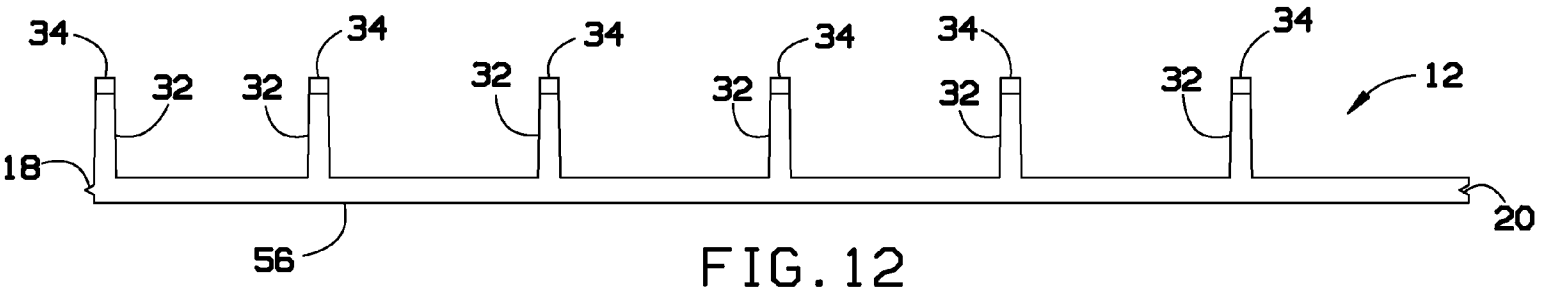
FIG. 12 is a top view of the intermediate concrete segment of FIG. 2.
Figure 13:
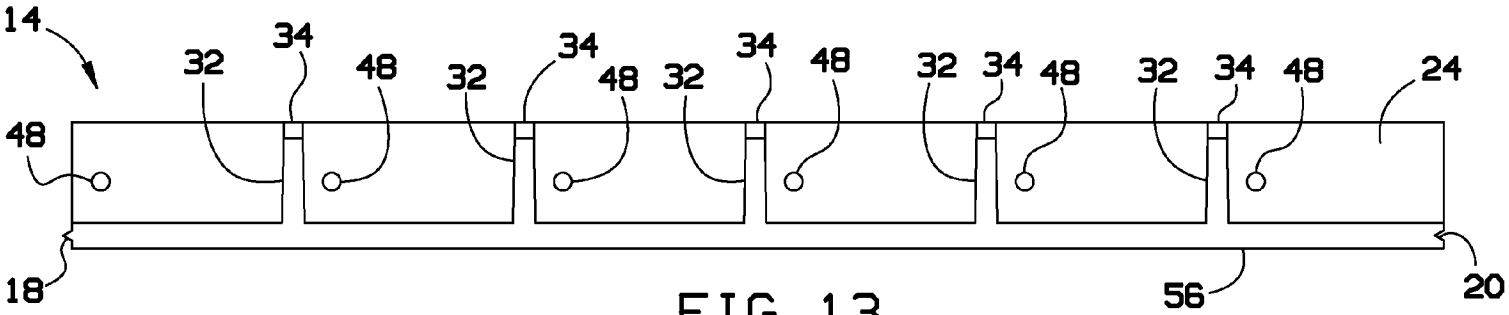
FIG. 13 is a top view of the base concrete segment of FIG. 7.
Figure 14:
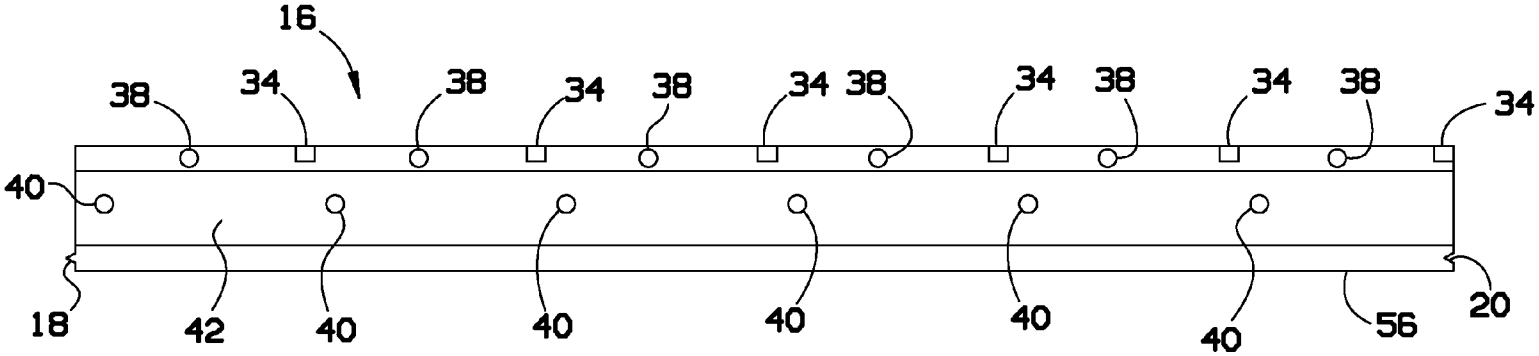
FIG. 14 is a top view of the top concrete segment FIG. 10.

Reinforcement steel 26 may extend from the exterior finish 56 into the stud sections 32 as shown in FIG. 3. In addition, reinforcement steel 26 may be disposed to run lengthwise along the concrete base 24 as shown in FIG. 8.

The ends of the decorative exterior finish 56 may join together with a tongue and groove type of joint. For example, one end of the exterior finish 56 may have a male V-notch, while the opposite end of the exterior finish 56 may have a female V-notch. This joint provides horizontal alignment of adjoining wall segments (such as adjoining base concrete segments 14).

The wall system 10 may further include a plurality of intermediate concrete segments 12. The intermediate concrete segments 12 may stack on top of each other and on top of the base concrete segment 14. The intermediate concrete segments 12 may include the decorative exterior finish 56 similar to that of the base concrete segments 12. Similar to the base concrete segment 12 described above, the ends of the exterior finish 56 may include male and female V-notches 18, 20. The intermediate concrete segments 12 may include stud sections 32. When the intermediate concrete segments 12 are stacked on each other or on the base concrete segment 14, the stud sections 32 may align to form "studs" on the interior of the wall system 10.

The stud sections 32 of the base concrete segments 14 and the intermediate concrete segments 12 may have interlocking tabs 28 on a top portion thereof. The stud sections 32 of the intermediate concrete segments 12 may include interlocking notches 30 on a bottom portion thereof. The interlocking notches 30 may align with the interlocking tabs 28 to help align the "studs" vertically.

In some embodiments, the intermediate concrete segments 12 may include a utility access hole 22 formed through each of the stud sections 32. The utility access holes 22 may be smooth holes to permit utilities, such as plumbing pipes or electrical wires, to pass therethrough.

A top concrete segment 16 may include the decorative exterior finish similar to the base concrete segments 12 and the intermediate concrete segments 14. Similar to the base concrete segments 12 and the intermediate concrete segments 14 described above, the ends of the exterior finish 56 may include male and female V-notches 18, 20.

The top concrete segment 16 may be formed in as a generally U-shaped, with a channel 42 adapted to be filled with concrete and reinforcement steel after construction.

The top concrete segment 16 may include interlocking notches 30 formed along a bottom side thereof to align with the interlocking tabs 28 on the last (top) row of intermediate concrete segments 12. Utility access holes 38 may be provided through the top concrete segment 16 to provide a path for utilities to extend through the top concrete segment 16 to, for example, go into a roof part of a building (not shown).

Figure 15:
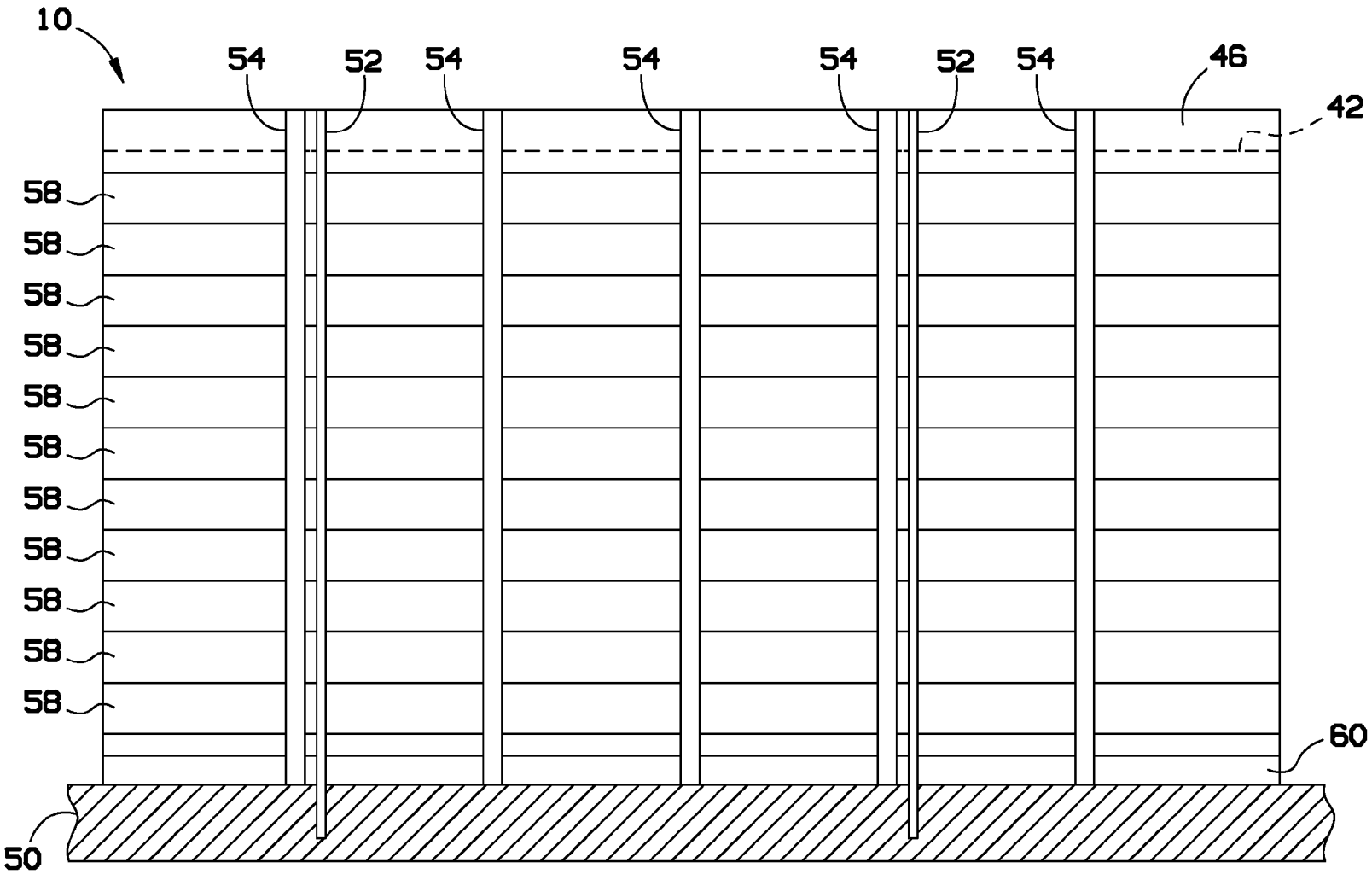
FIG. 15 is a side view of an assembled wall according to an exemplary embodiment of the present invention.

The top concrete segment 16 may have a plurality of holes 40 formed along a base thereof. The holes 40 may permit a anchoring segment 52 to run from the top concrete segment 16, into the foundation footing 50, as shown in FIG. 15. Similarly, holes 48 may be formed through the base concrete segment 14 for the anchoring segments 52 to pass therethrough.

As shown in FIG. 15, a complete wall system 10, as viewed from the inside, may have assembled framing studs 54, typically disposed 16 inches apart, on center. Typically, the ends of the base concrete segments 14, the intermediate concrete segments 12 and the top concrete segment 16 are staggered so that they do not form a continuous seam along the wall. The wall system 10 of the present invention may be used to build various residential and/or commercial structures.

It should be understood, of course, that the foregoing relates to exemplary embodiments of the invention and that modifications may be made without departing from the spirit and scope of the invention as set forth in the following claims.

What is claimed is:

1. A wall segment for a wall system, comprising:

a precast concrete portion including an exterior wall section and a plurality of stud sections extending inward from the wall section, each stud section including an upper edge, a lower edge and an interior edge;

each stud section including a first interlocking structure formed or one of the upper and lower edges, and a complementary second interlocking structure formed on the other of the upper and lower edges; and a framing material strip section attached to the interior edge of each of the stud sections; and a reinforcement steel support extending into each of the stud sections from the exterior wall section.

2. A wall segment for a wall system, comprising:

a precast concrete portion including an exterior wall section and a plurality of stud sections extending inward from the wall section, each stud section including an upper edge, a lower edge and an interior edge;

each stud section including a first interlocking structure formed or one of the upper and lower edges, and a complementary second interlocking structure formed on the other of the upper and lower edges;

a framing material strip section attached to the interior edge of each of the stud sections and the plurality of stud sections are laterally equally spaced apart, a first one of the stud sections being adjacent a first lateral end of the exterior wall section, and a last one of the stud sections furthest from the first one of the stud sections being spaced from a second lateral end of the exterior wall section.

3. The wall segment of claim 2, wherein:

the plurality of stud sections includes six stud sections spaced apart on sixteen inch centers.

4. The wall segment of claim 2, wherein:

the exterior wall section includes a first lateral end having a female v-notch and a second lateral end having a male v-notch substantially complementary to the female v-notch.

5. The wall segment of claim 2, wherein:

each of the stud sections has a laterally extending utility access hole disposed therethrough.

6. The wall segment of claim 2, wherein:

the first and second complementary interlocking structures of each stud section are configured such that the wall segment can be stacked on a second identical wall segment with the first interlocking structures of the first mentioned wall segment engaging the second interlocking structures of the second wall segment to vertically align the stud sections of the two stacked wall segments.

7. A wall system, comprising:

a plurality of vertically stacked horizontally extending wall segments, each wall segment including:

a precast concrete portion including an exterior wall section and a plurality of stud sections extending inward from the exterior wall section, each stud section including a male interlocking structure on one of an upper and a lower edge thereof and a female interlocking structure on the other of the upper and the lower edge thereof; and a framing material strip section attached to an interior edge of each of the stud sections;

the plurality of stacked wall segments being configured such that the exterior wall sections of vertically adjacent wall segments are stacked on each other, and the stud sections of vertically adjacent wall segments are stacked on each other to form vertically extending framing studs of the wall system, with the male interlocking structures of the stud sections of one wall segment being received in the female interlocking structures of the stud sections of a vertically adjacent wall segment, and with the framing material strip sections of vertically adjacent stacked stud sections being vertically aligned to form vertically extending framing material strips of the wall system; and wherein each wall segment includes six stud sections on sixteen inch centers, and one of the six stud sections is adjacent a first lateral end of the wall section of the wall segment, and a sixth one of the six stud sections is spaced from a second lateral end of the wall section.

8. A wall system, comprising:

a plurality of vertically stacked horizontally extending wall segments, each wall segment including:

a precast concrete portion including an exterior wall section and a plurality of stud sections extending inward from the exterior wall section, each stud section including a male interlocking structure on one of an upper and a lower edge thereof and a female interlocking structure on the other of the upper and the lower edge thereof;

a framing material strip section attached to an interior edge of each of the stud sections; and a reinforcement steel support extending from the exterior wall section into each of the stud sections;

the plurality of stacked wall segments being configured such that the exterior wall sections of vertically adjacent wall segments are stacked on each other, and the stud sections of vertically adjacent wall segments are stacked on each other to form vertically extending framing studs of the wall system, with the male interlocking structures of the stud sections of one wall segment being received in the female interlocking structures of the stud sections of a vertically adjacent wall segment, and with the framing material strip sections of vertically adjacent stacked stud sections being vertically aligned to form vertically extending framing material strips of the wall system.

9. The wall system of claim 8, wherein:

each wall segment includes a first lateral end having a female V-notch and a second lateral end having a male V-notch substantially complementary to the female V-notch.

10. The wall system of claim 8, wherein:

at least one of the wall segments includes a laterally extending utility access hole through each of the stud sections of the at least one of the wall segments.

11. The wall system of claim 8, wherein:

the exterior wall section of each precast concrete portion has a decorative finish thereon.

12. The wall system of claim 8, wherein:

the male and female interlocking structures of the stud sections are configured to align the stud sections vertically to form the vertically extending framing studs of the wall system.

13. The wall system of claim 8, wherein:

the male interlocking structures comprise tabs; and the female interlocking structures comprise notches.

14. The wall system of claim 8, wherein:

the plurality of vertically stacked wall segments are intermediate wall segments; and the wall system further comprises:

a base segment located below the plurality of vertically stacked intermediate wall segments; and a top segment located on top of the plurality of vertically stacked intermediate wall segments.

15. The wall system of claim 14, further comprising:

an anchoring rod extending vertically between the base segment and the top segment.

16. The wall system of claim 8, wherein:

each wall segment includes six stud sections.

17. The wall system of claim 16, wherein:

the stud sections are on sixteen inch centers.

* * * * *

UNITED STATES PATENT AND TRADEMARK OFFICE

CERTIFICATE OF CORRECTION

PATENT NO. : 9,309,667 B2
APPLICATION NO. : 13/445871
DATED : April 12, 2016
INVENTOR(S) : Thompson et al.

It is certified that error appears in the above-identified patent and that said Letters Patent is hereby corrected as shown below:

In the claims

Column 4, line 27, replace “or” with --on--;
Column 4, line 40, replace “or” with --on--.

Signed and Sealed this
Twenty-fourth Day of May, 2016

Michelle K. Lee

Michelle K. Lee
*Director of the United States Patent and Trademark Office*